US007073515B2

(12) United States Patent
Mayfield et al.

(10) Patent No.: US 7,073,515 B2
(45) Date of Patent: Jul. 11, 2006

(54) LOCKABLE ASHTRAY

(76) Inventors: Michael D. Mayfield, 32330 Shrimp La., Winchester, CA (US) 92596; Bill Fedorow, 42555 Granado Pl., Temecula, CA (US) 92590

( * ) Notice: Subject to any disclaimer, the term of this patent is extended or adjusted under 35 U.S.C. 154(b) by 0 days.

(21) Appl. No.: 10/639,618

(22) Filed: Aug. 13, 2003

(65) Prior Publication Data

US 2005/0034736 A1 Feb. 17, 2005

(51) Int. Cl.
*A24D 1/12* (2006.01)

(52) U.S. Cl. ..... 131/231; 131/242; 220/576; 206/246

(58) Field of Classification Search ..... 131/231, 131/242; D27/102, 107, 122; 220/576; 206/246
See application file for complete search history.

(56) References Cited

U.S. PATENT DOCUMENTS 2,000,275 A * 5/1935 De Boer ..... 224/280
2,765,794 A * 10/1956 Sheppard ..... 131/235.1
2,973,879 A * 3/1961 Darst ..... 220/502
3,276,440 A * 10/1966 Sazegar ..... 126/25 A
3,802,560 A * 4/1974 Kesinger et al. ..... 209/235
4,571,250 A * 2/1986 Irmscher et al. ..... 55/359
4,621,746 A 11/1986 Reichle et al.
5,379,787 A 1/1995 Haines
6,076,694 A 6/2000 Ragot
6,186,355 B1 * 2/2001 Luedecke ..... 220/576
6,454,122 B1 * 9/2002 Luedecke ..... 220/576
6,626,322 B1 * 9/2003 Carter et al. ..... 220/576
2002/0190615 A1 12/2002 Lin

FOREIGN PATENT DOCUMENTS

JP 109701 * 4/1998

OTHER PUBLICATIONS

"National Institute on Drug Abuse", http://www.drugabuse.gov/WHGD/WHGDDirRep6.html, 4 pages, Sep. 1996.
McGee D, Brabson T, McCarthy J, Picciotti M. : "Four-year review of cigarette ingestions in children," *Pediatr Emerg Care*, Feb. 1995, 11(1) :13-6.
Aloot CB, Vredevoe DL, Brecht ML: "Evaluation of high-risk smoking practices used by the homeless," *Cancer Nursing*, Apr. 1993, 16(2), pp. 123-130.

* cited by examiner

*Primary Examiner*—Dionne W. Mayes
(74) *Attorney, Agent, or Firm*—Richard C. Litman

(57) ABSTRACT

The invention is directed to a lockable ashtray comprising a cover defining at least one aperture therein, a hinge connecting the cover to a lower section. The cover is reversibly locked to the lower section or the cylinder shaped vessel. A Tray for holding cigarette butts is located out of sight beneath the cover. The at least one aperture has a diameter or width sufficiently small to hinder an adult or child intent on removing cigarette butts from the ashtray. In another embodiment the cover defining at least one aperture is attached to a cylinder shaped vessel having an inner lining defining an internal cavity at least partly filled with a bottom layer of immobile material and an upper layer of nonflammable material.

2 Claims, 6 Drawing Sheets

LOCKABLE ASHTRAY

BACKGROUND OF THE INVENTION

1. Field of the Invention

The present invention relates generally to ashtrays. Specifically, the invention is a lockable ashtray that hides cigarette butts from view.

2. Description of the Related Art

The risks posed to children by cigarette butts are well known. For example, government and other health agencies frequently advise adult smokers to ensure that ashtrays and cigarette butts are kept away from the reach of children to help prevent children from ingesting or inhaling the cigarette butts (see, e.g., world wide web (www) sites: http://www.s-ph.unc.edu/smokefreekids/what/parent_text.htm, and http://www.drugabuse.gov/WHGD/WHGDDirRep6.html). The risk posed by cigarette butts is not limited to one country and impacts on the health of children around the world (see, e.g., http://www.health.gov.fj/tobacco.htm).

Very young children like to mimic adults. For example, a very young child might pick up a butt from an ashtray and place the butt in their mouth to mimic a parent who has a smoking habit. Very young children can ingest cigarette butts and suffer poisoning incidents because of toxins trapped in ingested filters. For example, between 1988 and 1991 seven hundred children under six years of age were reported to the Poison Control Center as a result of ingesting cigarette butts, McGee D, Brabson T, McCarthy J, Picciotti M.: "Four-year review of cigarette ingestions in children," *Pediatr Emerg Care,* 1995 February, 11(1):13–6.

Homeless people sometimes engage in high-risk smoking practices such as using cigarette butts found in ashtrays. A recent study found that such high-risk smoking practices pose an increased risk of exposure to toxins trapped in filters and tobacco remains, and increase the threat of infectious disease transmission, Aloot C B, Vredevoe D L, Brecht M L: "Evaluation of high-risk smoking practices used by the homeless," *Cancer Nursing,* 1993 April, 16(2), pp 123–30. Thus, there has been a long felt need for ways to help prevent homeless people and children gaining access to cigarette butts.

U.S. Pat. No. 5,379,787, issued Jan. 10, 1995 to R. K. Haines, describes a pop-up ashtray comprising a hinged lid. The contents of the '787 ashtray are accessed by applying minimal pressure to open the lid. The '787 device does not hinder a child from accessing cigarette butts.

U.S. Pat. No. 6,076,694, issued Jun. 20, 2000 to Paul-Henri Ragot, describes a trash receptacle that comprises an outer container and an inner trashcan. The '694 device is not especially designed to handle butts. For example, in one embodiment (FIGS. 1 to 5) cigarette butts and general trash are thrown through a pair of self-closing gravity doors (member #28). The '694 patent teaches in FIG. 8 to place ashtrays in accessible locations on a plurality of outer posts (member #36). Thus, the '694 patent teaches away from the present invention.

U.S. Publication No. 20020190615 A1, published Dec. 19, 2002 to C. J. Lin, describes a garbage-box having a container body and a collection container. The '615 device includes a large garbage inlet that automatically opens in response to a sensor that senses the approach of a person. An accessible ashtray is provided proximate to the large garbage inlet thus allowing a child or homeless person to rifle through the ashtray to obtain butts.

U.S. Pat. No. 4,621,746, issued Nov. 11, 1986 to Reichle, et al., describes a device for vending newspapers. The '746 device comprises a horizontally disposed drum mounted on a pedestal. A clear plastic dome is used to cover the open top of the drum. A lock and key arrangement is provided so that the dome may be secured to the drum and easily removed therefrom. The '746 device does not teach or suggest the present invention.

None of the above inventions and patents, taken either singly or in combination, is seen to describe the instant invention as claimed. Thus a lockable ashtray solving the aforementioned problems is desired.

SUMMARY OF THE INVENTION

The invention is directed to a lockable ashtray that comprises a cover defining at least one aperture therein, and a hinge connecting the cover to a lower section. The cover is reversibly locked to the lower section. A tray for holding cigarette butts is located out of sight beneath the hinged cover. The at least one aperture has a diameter or width sufficiently small to hinder an adult or child intent on removing cigarette butts from the ashtray. In another embodiment the cover defining at least one aperture is attached to a cylinder shaped vessel having an inner lining defining an internal cavity at least partly filled with a bottom layer of immobile material and an upper layer of nonflammable material.

Accordingly, it is a principal object of the invention to provide a lockable ashtray for depositing and temporarily storing discarded cigarette butts.

It is another object of the invention to provide a lockable ashtray that hinders an adult or child intent on removing cigarette butts from the lockable ashtray.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates generally to ashtrays. Specifically, the invention is a lockable ashtray that hides cigarette butts from view. In a preferred embodiment the invention is an ashtray with a lockable-hinged dome cover to hide discarded cigarette butts from view. Still more specifically, the invention is an ashtray that reduces the accessibility of discarded butts to children and homeless people who might desire access to discarded butts.

Figure 1:
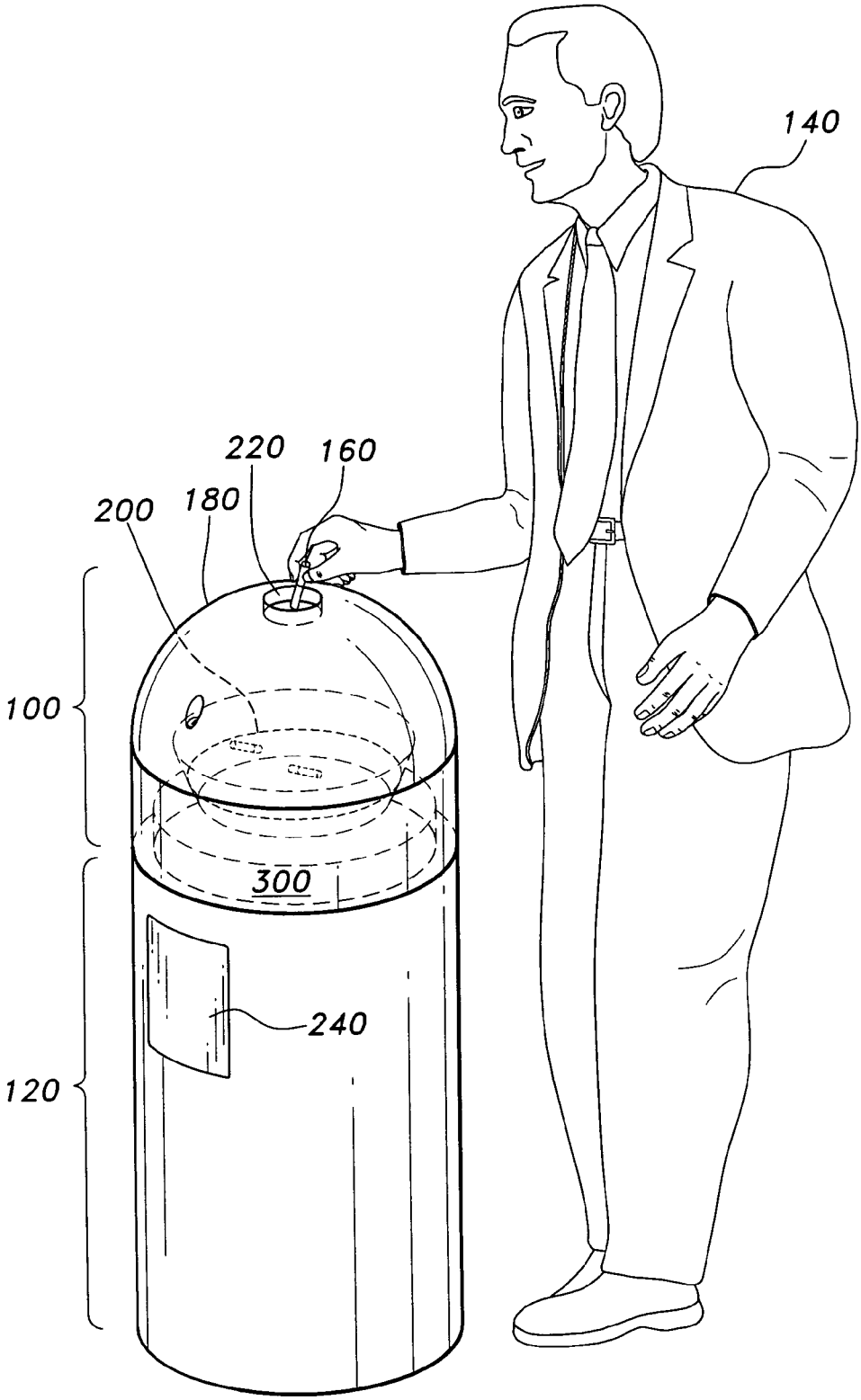
FIG. 1 is an environmental, perspective view of a lockable ashtray on top of a trashcan according to the present invention.

FIG. 1 shows an environmental, perspective view of a lockable ashtray denoted generally by the reference numeral 100. In this embodiment the lockable ashtray 100 sits atop a trashcan 120 of generally cylindrical shape. The trashcan 120 defines an inlet 240 for handling general trash. It should be understood that the terms "used cigarette" and "cigarette butt" are regarded as equivalent terms.

Still referring to FIG. 1, an adult smoker 140 is shown discarding a cigarette butt 160 into the lockable ashtray 100. The lockable ashtray 100 comprises a dome shaped cover member 180 and a butt collection tray 200 hidden from general view beneath the dome shaped cover 180. The dome shaped cover member 180 is substantially hemi-spherical, as seen in FIGS. 1–4B. Also, it is remarkable that the illustrated substantially hemi-spherical dome shaped cover member 180 has a substantially planar upper surface in the embodiment of FIGS. 3A and 3B. The dome shaped cover member 180 defines at least one aperture 220 and an inner chamber 225 (see FIG. 2A). The cigarette butts 160 are dropped through the at least one aperture 220 and fall through the inner chamber 225 to land on the tray 200; the tray 200 is located out of sight beneath the dome shaped cover 180.

It should be understood that the at least one aperture 220 can be any suitable shape such as a circular shape, a star shape, a square shape, a generally rectangular shape, and/or an elongated slit shape. A circular shaped at least one aperture 220 is defined in terms of its diameter "d1" (see FIG. 2A and accompanying description below). An at least one aperture 220 in the form of a square shape, a generally rectangular shape, and/or an elongated slit shape is defined in terms of its width "w1" (see FIG. 3A and accompanying description below).

It should also be understood that the cover 180 could be any suitable shape such as a cone shaped cover 180*b* (see FIG. 5A) or a generally rectangular shape. It will be understood that the tray 200 is difficult to view by a child or homeless adult because the cover 180 lowers the amount of light that would otherwise fall on the tray 200. In addition, even if an artificial light is shone through the at least one aperture 220 it would still be difficult for a child or homeless adult to see all of the tray 200 and any cigarette butts 160 deposited thereon.

Figure 2A:
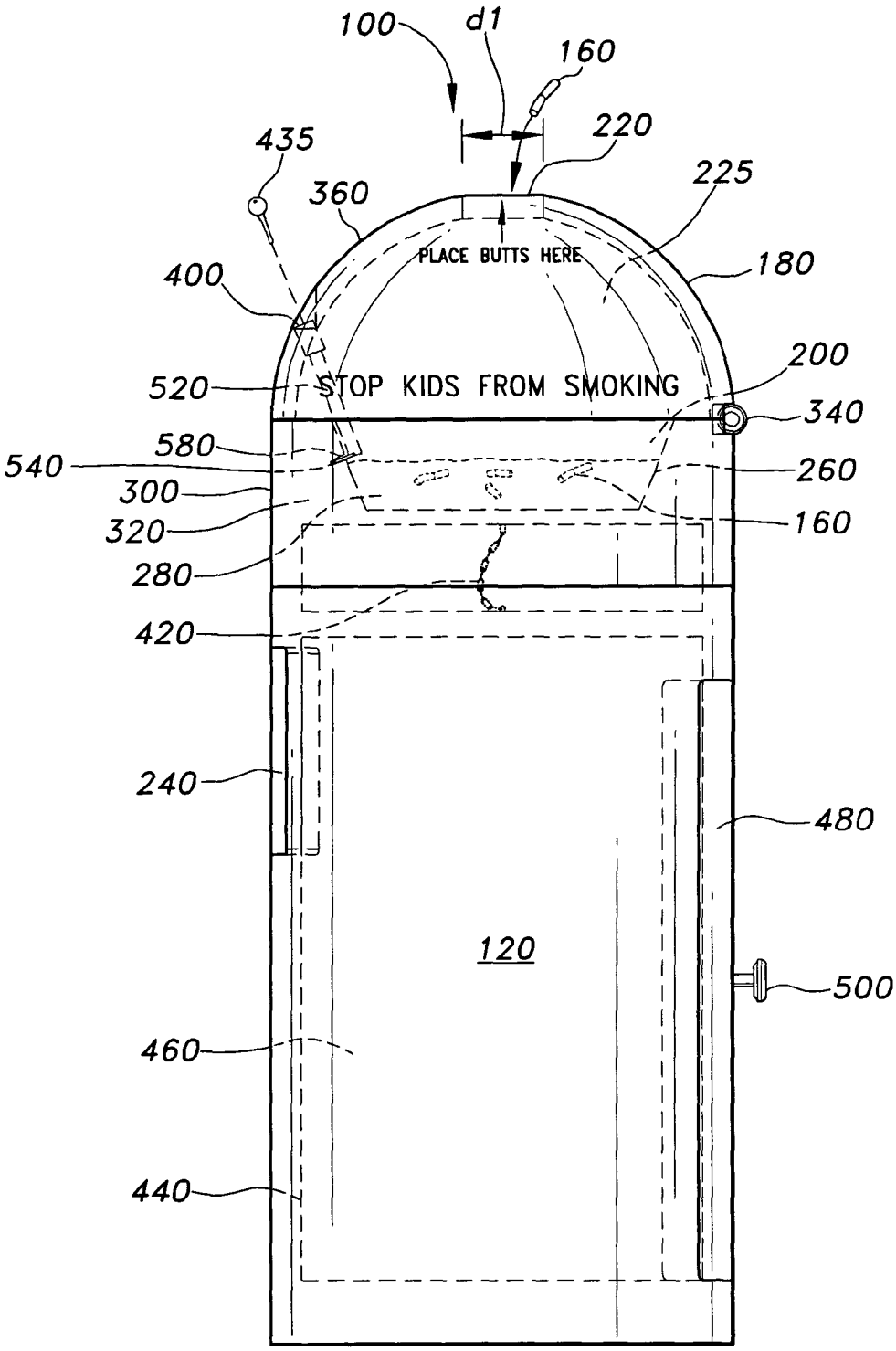
FIG. 2A is a side view of the lockable ashtray and trashcan combination of FIG. 1.

FIG. 2A is a side view of the lockable ashtray 100 and trashcan 120 combination of FIG. 1. The tray 200 comprises a pan 260 that is optionally at least partly filled with a nonflammable material 280 such as sand. The discarded cigarette butts 160 are dropped onto the nonflammable material 280 via the at least one aperture 220. The dome shaped cover member 180 is hinged to a lower section member 300. The lower section member 300 defines an interior volume 320. The tray 200 is located beneath the dome shaped cover member 180 and inside the interior volume 320. A hinge 340 allows the dome shaped cover member 180 to be moved between a closed position 360 and an open position 380 (see FIG. 2B). A key 435 operates a recessed lock 400 that reversibly locks the dome shaped cover member 180 to the lower section 300. The lower section 300 further comprises an interface member 420, such as a chain, that connects the lower section 300 to the optional trashcan 120.

Still referring to FIG. 2A, the trashcan 120 comprises an inner lining 440 defining an inner chamber 460. General trash is pushed through the inlet 240 into the inner chamber 460. A door 480, defining a door knob 500, allows access and removal of trash from the inner chamber 460. A trash bag may be used to line the inner lining 440; when the trash bag is full it is easily removed and replaced via the access door 480.

Figure 2B:
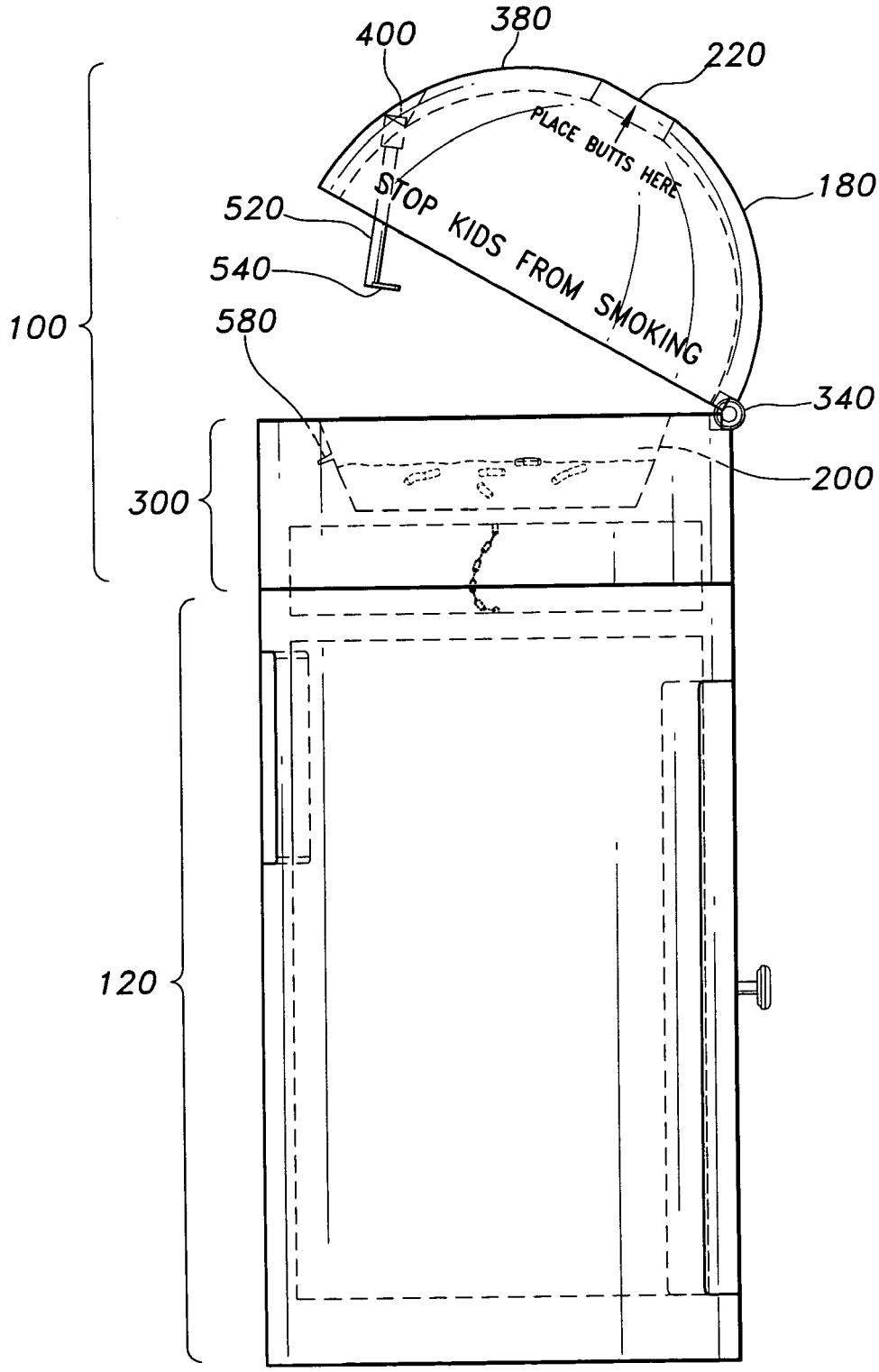
FIG. 2B is a further side view of the lockable ashtray and trashcan combination of FIG. 1.

FIG. 2B is a further side view of the lockable ashtray 100 and trashcan 120 combination of FIG. 1, wherein the cover 180 is shown in the open position 380. The recessed lock 400 comprises a stem 520 and a catch 540. The stem 520 and attached catch 540 rotate in sympathy when the key 435 (see FIG. 2A) is inserted, and rotated, into the lock 400. When the dome shaped cover 180 is in the closed position 360 the catch 540 rests against an inverted ledge 580 thereby locking the dome shaped cover 180 to the lower section 300. Turning the lock 400 until the catch 540 is no longer resting against the inverted ledge 580 allows the dome shaped cover 180 to be manually moved from the closed position 360 (FIG. 2A) to the open position 380 (FIG. 2B). An operator is then free to clean out the tray 200 of butts 160.

The at least one aperture 220 is preferably sized to make it difficult for a person, such as a child or homeless person, to get their hand through the at least one aperture 220. The at least one aperture 220 has a diameter dl of preferably less than about two inches (i.e., less than about 2"), more preferably between about 0.5 inches and two inches (i.e., between about 0.5" and 2"), and still more preferably between about one inch and two inches (i.e., between about 1" and 2"). The most preferred diameter is about one inch (i.e., about 1"); a diameter of about 1" easily prevents a child or adult accessing discarded cigarette butts 160 in the tray 200.

Figure 3A:
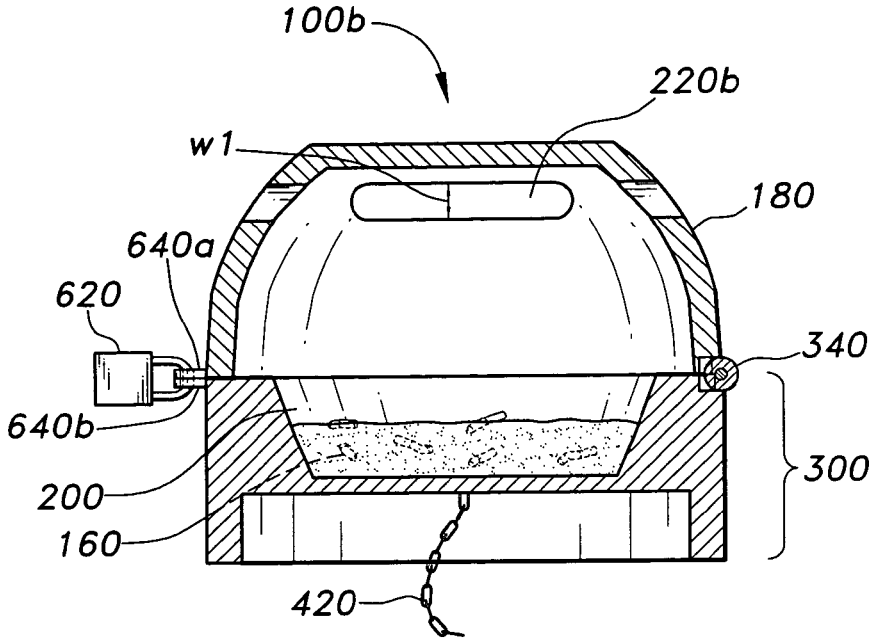
FIG. 3A is a section view of a lockable ashtray with narrow elongated apertures according to the present invention.
Figure 3B:
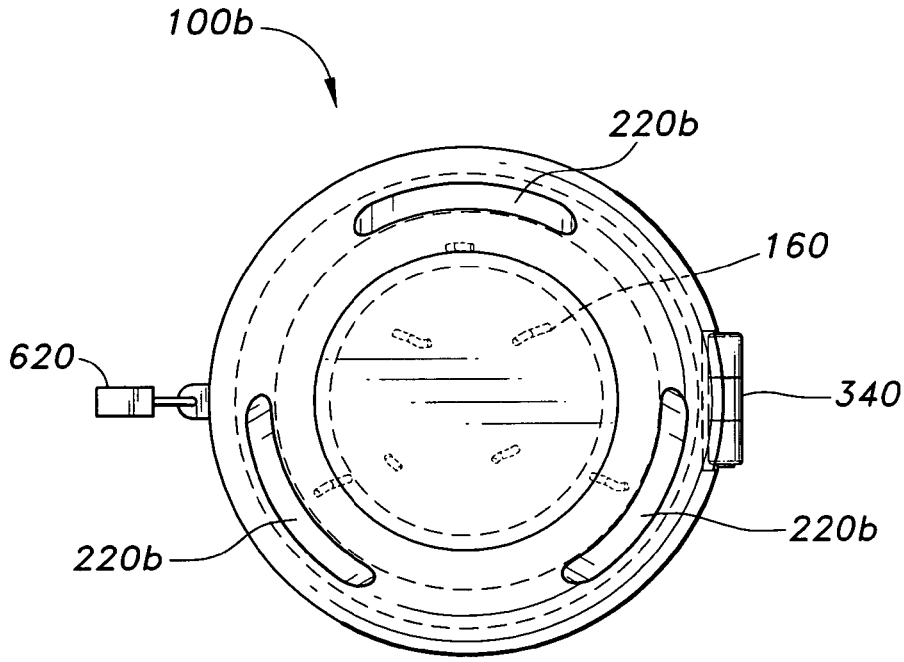
FIG. 3B is a top view of the lockable ashtray of FIG. 3A.

FIG. 3A shows a section view of a further embodiment of lockable ashtray 100 (shown as "100*b*") in which the dome shaped cover 180 defines at least one narrow elongated aperture 220*b*. The at least one aperture 220*b* has a width (shown as "w1") between about 0.5 inches and 1 inch (i.e., between about 0.5" and 1"). A padlock 620 secures two lock brackets 640*a* and 640*b* connected, respectively, to the dome shaped cover 180 and lower section 300. In this embodiment the lockable ashtray 100*b* is either used separately from the trashcan 120 or attached to the trashcan 120 by means of the interface member 420. FIG. 3B shows a top view of the lockable ashtray 100*b* of FIG. 3A.

Figure 4A:
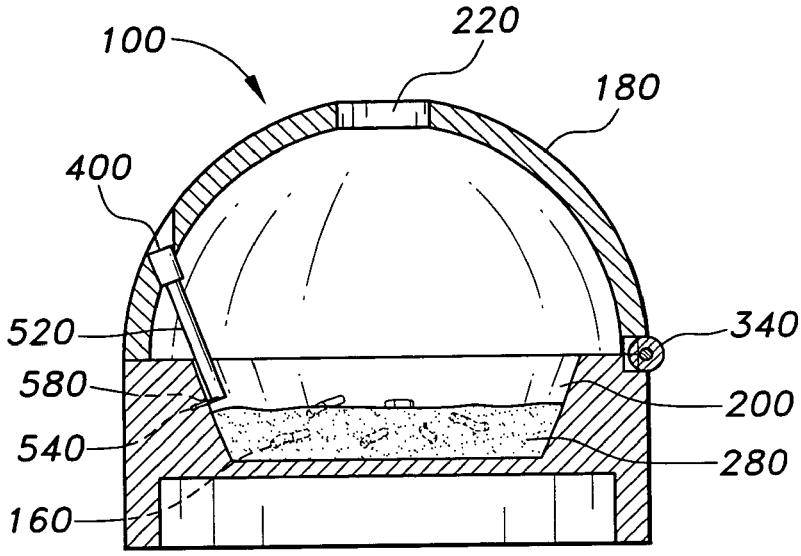
FIG. 4A is a section view of the lockable ashtray of FIG. 1.
Figure 4B:
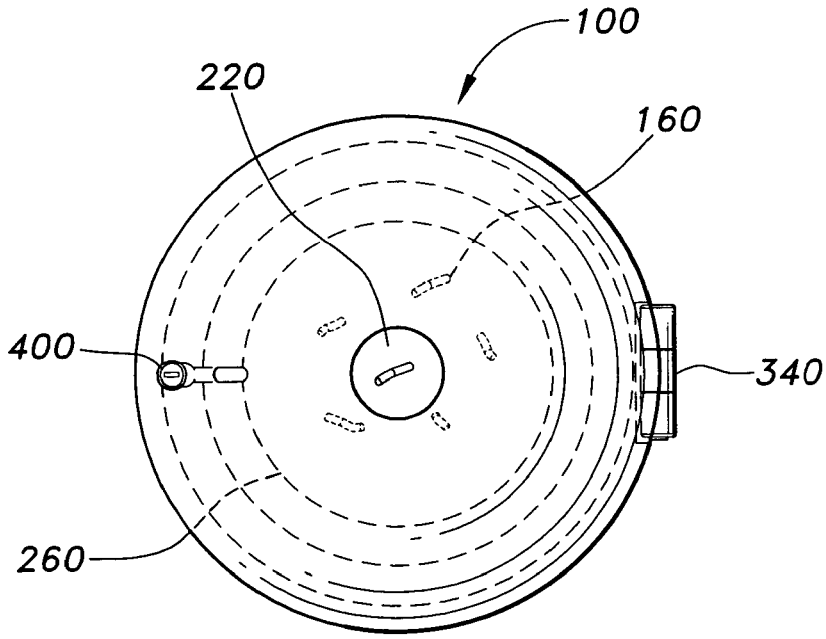
FIG. 4B is a top view of the lockable ashtray of FIG. 1.

FIG. 4A shows a section view of the lockable ashtray 100 shown in FIGS. 1 and 2, wherein the lockable ashtray 100 is used separately from the trashcan 120. In this configuration the lockable ashtray 100 may be positioned on any suitable flat surface such as that provided by an outside wall or table. FIG. 4B shows a top view of the lockable ashtray 100 of FIG. 3A.

Figure 5A:
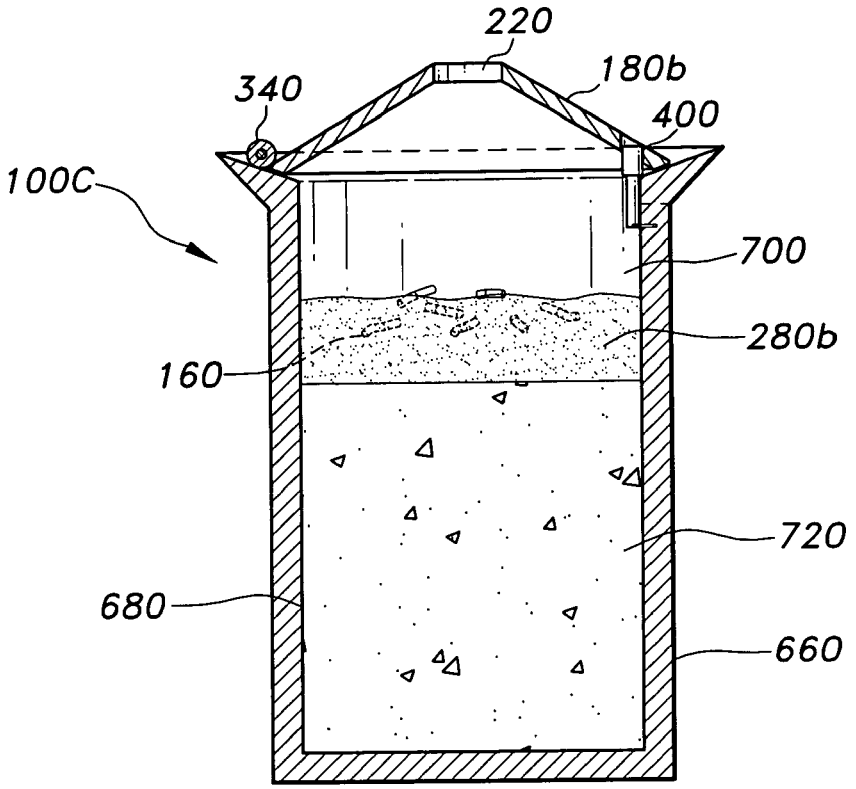
FIG. 5A is a section view of a further embodiment of the lockable ashtray according to the present invention.
Figure 5B:
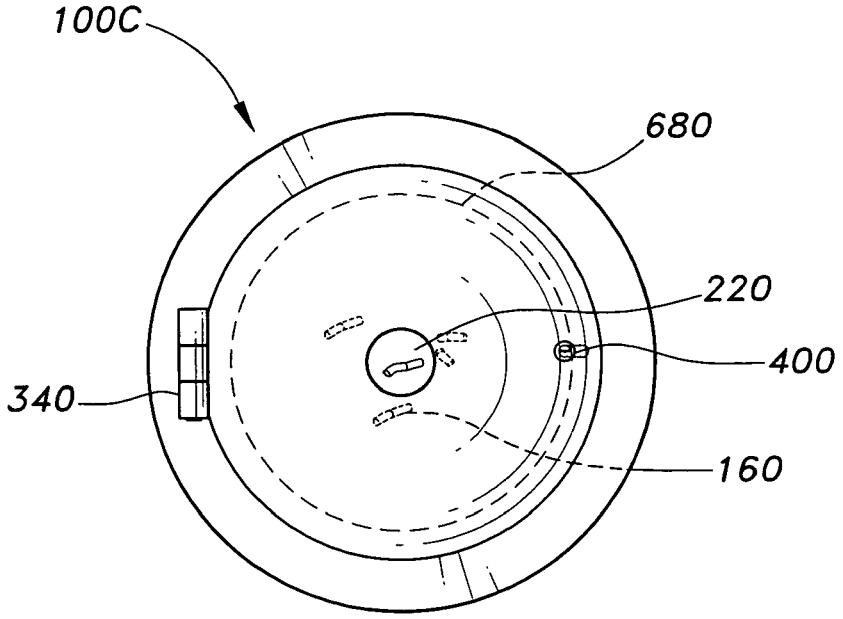
FIG. 5B is a top view of the lockable ashtray of FIG. 5A.

FIG. 5A shows a section view of a still further embodiment of the invention in which the lockable ashtray (shown as "100*c*") comprises a cone shaped cover 180*b* defining the at least one aperture 220 of circular dimensions with a diameter between about 0.5 inches and two inches (i.e., between about 0.5" and 2"), and more preferably a diameter of about one inch (i.e., about 1"). The lockable ashtray 100*c* further comprises a cylinder shaped vessel 660 having an inner lining 680 defining an internal cavity 700 at least partly filled with a bottom layer of immobile material 720, such as cured concrete, and an upper layer of the nonflammable material 280*b* such as sand which may be removed or replaced. The combination of the bottom layer 720 and upper layer 280*b* serve as a butt collection tray that is hidden from view. Cigarette butts 160 are dropped through the at least one aperture 220 and land on the layer of nonflammable material 280*b*. The cigarette butts 160 may be removed periodically by unlocking the lock 400 and opening the coned shaped cover 180*b*. FIG. 5B shows a top view of the lockable ashtray 100*c* of FIG. 5A.

It will be understood that a child and/or homeless adult would find it hard to view any cigarette butts 160 deposited on the upper layer 280*b* because the cover 180*b* lowers the amount of light that would otherwise fall on the upper layer 280*b*. In addition, even if an artificial light is shone through the at least one aperture 220 it would still be difficult for a child or homeless adult to see all of the upper layer 280*b* and any cigarette butts 160 deposited thereon.

It is to be understood that the present invention is not limited to the embodiments described above, but encompasses any and all embodiments within the scope of the following claims.

We claim:

1. A lockable ashtray for depositing and temporarily storing cigarette butts, comprising:

a cone shaped cover defining at least one aperture of circular dimensions between about 0.5" and 2" in diameter;

a cylinder shaped vessel having an inner lining defining an internal cavity at least partly filled with a bottom layer of immobile material and an upper layer of a nonflammable material; and a lock to reversibly secure said cover to said cylinder shaped vessel, whereby said lockable ashtray solves the problem of hiding cigarette butts from view while simultaneously inhibiting children or adults from gaining access to the ashtray.

2. The lockable ashtray according to claim 1, wherein said aperture has a diameter of about 1".

* * * * *